US012290225B2

(12) United States Patent
Boyer et al.

(10) Patent No.: US 12,290,225 B2
(45) Date of Patent: May 6, 2025

(54) DISHWASHER WITH WALKING TUBULAR SPRAY ELEMENT

(71) Applicant: Midea Group Co., Ltd., Foshan (CN)

(72) Inventors: Joel Boyer, Louisville, KY (US); Bassam Fawaz, Louisville, KY (US); Mark W. Wilson, Simpsonville, KY (US); Robert M. Digman, Goshen, KY (US); Timothy Martin Wetzel, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 398 days.

(21) Appl. No.: 17/848,858

(22) Filed: Jun. 24, 2022

(65) Prior Publication Data

US 2022/0313056 A1 Oct. 6, 2022

Related U.S. Application Data

(63) Continuation-in-part of application No. 17/323,350, filed on May 18, 2021, now Pat. No. 11,800,963, (Continued)

(51) Int. Cl.
*A47L 15/22* (2006.01)
*A47L 15/42* (2006.01)
(Continued)

(52) U.S. Cl.
CPC ..... *A47L 15/22* (2013.01); *A47L 15/4221* (2013.01); *A47L 15/4293* (2013.01);
(Continued)

(58) Field of Classification Search
CPC .. A47L 15/22; A47L 15/4221; A47L 15/4293; A47L 15/449; A47L 15/46;
(Continued)

(56) References Cited

U.S. PATENT DOCUMENTS 2,808,063 A 10/1957 Abresch et al.
2,907,335 A 10/1959 Abresch
(Continued)

FOREIGN PATENT DOCUMENTS

CN 2094961 U 2/1992
CN 2395683 Y 9/2000
(Continued)

OTHER PUBLICATIONS

Lorenzi, Marc, United States Patent and Trademark Office, Non-Final Office Action issued in U.S. Appl. No. 17/225,442, 102 pages, dated Mar. 27, 2024.
(Continued)

*Primary Examiner* — Tinsae B Ayalew
(74) *Attorney, Agent, or Firm* — Gray Ice Higdon

(57) ABSTRACT

A dishwasher and method for making and/or using the same utilize one or more walking tubular spray elements that may be used to effectively increase the spray coverage area of the tubular spray elements through rotation and/or movement of the walking tubular spray elements in directions other than about the longitudinal axes thereof.

19 Claims, 6 Drawing Sheets

Related U.S. Application Data which is a continuation of application No. 16/707,181, filed on Dec. 9, 2019, now Pat. No. 11,058,279, which is a continuation of application No. 15/721,099, filed on Sep. 29, 2017, now Pat. No. 10,531,781.

(51) Int. Cl.

| | |
|---|---|
| ***A47L 15/44*** | (2006.01) |
| ***A47L 15/46*** | (2006.01) |
| ***A47L 15/48*** | (2006.01) |
| ***A47L 15/50*** | (2006.01) |

(52) U.S. Cl.

CPC ..... *A47L 15/449* (2013.01); *A47L 15/46* (2013.01); *A47L 15/486* (2013.01); *A47L 15/507* (2013.01); *A47L 2501/01* (2013.01); *A47L 2501/04* (2013.01); *A47L 2501/12* (2013.01)

(58) Field of Classification Search

CPC .. A47L 15/486; A47L 15/507; A47L 2501/01; A47L 2501/04; A47L 2501/12

USPC ..... 134/25.2

See application file for complete search history.

(56) References Cited

U.S. PATENT DOCUMENTS

| | | | |
|---|---|---|---|
| 2,992,779 | A | 1/1960 | James et al. |
| 2,939,465 | A | 6/1960 | Kesling |
| 2,956,572 | A | 10/1960 | Levit et al. |
| 2,973,907 | A | 3/1961 | Abresch et al. |
| 2,980,120 | A | 4/1961 | Jacobs |
| 3,006,557 | A | 10/1961 | Jacobs |
| 3,026,046 | A | 3/1962 | Wickham et al. |
| 3,044,842 | A | 7/1962 | Abresch et al. |
| 3,051,183 | A | 8/1962 | Jacobs |
| 3,077,200 | A | 2/1963 | Guth |
| 3,082,779 | A | 3/1963 | Jacobs |
| 3,088,474 | A | 5/1963 | Leslie |
| 3,101,730 | A | 8/1963 | Harris et al. |
| 3,115,306 | A | 12/1963 | Graham |
| 3,178,117 | A | 4/1965 | Hanifan |
| 3,192,935 | A | 7/1965 | Hanifan |
| 3,210,010 | A | 10/1965 | Delapena |
| 3,324,867 | A | 6/1967 | Freese |
| 3,348,775 | A | 10/1967 | Flame |
| 3,361,361 | A | 1/1968 | Schutte |
| 3,454,784 | A | 7/1969 | Wantz et al. |
| 3,538,927 | A | 11/1970 | Harald |
| 3,586,011 | A | 6/1971 | Mazza |
| 3,590,688 | A | 7/1971 | Brannon |
| 3,596,834 | A | 8/1971 | Cushing |
| 3,719,323 | A | 3/1973 | Raiser |
| 4,175,575 | A | 11/1979 | Cushing |
| 4,226,490 | A | 10/1980 | Jenkins et al. |
| 4,301,822 | A | 11/1981 | Dingler |
| 4,398,562 | A | 8/1983 | Saarem et al. |
| 4,657,188 | A | 4/1987 | Crane et al. |
| 4,718,440 | A | 1/1988 | Hawker et al. |
| 4,732,323 | A | 3/1988 | Jarvis et al. |
| 4,822,241 | A | 4/1989 | Jarvis et al. |
| 5,211,190 | A | 5/1993 | Johnson et al. |
| 5,226,454 | A | 7/1993 | Cabalfin |
| 5,341,827 | A | 8/1994 | Kim |
| 5,697,392 | A | 12/1997 | Johnson et al. |
| 5,725,002 | A | 3/1998 | Payzant |
| 5,752,533 | A | 5/1998 | Edwards |
| 5,927,616 | A | 7/1999 | Grise et al. |
| 6,053,185 | A | 3/2000 | Cirjak et al. |
| 6,431,188 | B1 | 8/2002 | Laszczewski, Jr. et al. |
| 6,612,009 | B1 | 9/2003 | Laszczewski, Jr. et al. |
| 6,694,990 | B2 | 2/2004 | Spanyer et al. |
| 6,869,029 | B2 | 3/2005 | Ochoa et al. |
| 7,055,537 | B2 | 6/2006 | Elick et al. |
| 7,210,315 | B2 | 5/2007 | Castelli et al. |
| 7,293,435 | B2 | 11/2007 | Elexpuru et al. |
| 7,445,013 | B2 | 11/2008 | VanderRoest et al. |
| 7,464,718 | B2 | 12/2008 | Mcintyre et al. |
| 7,556,049 | B2 | 7/2009 | Oakes et al. |
| 7,587,916 | B2 | 9/2009 | Rizzetto |
| 7,594,513 | B2 | 9/2009 | VanderRoest et al. |
| 7,607,325 | B2 | 10/2009 | Elexpuru et al. |
| 7,650,765 | B2 | 1/2010 | Rizzetto |
| 7,914,625 | B2 | 3/2011 | Bertsch et al. |
| 7,935,194 | B2 | 5/2011 | Rolek |
| 8,136,537 | B2 | 3/2012 | Cerrano et al. |
| 8,161,995 | B2 | 4/2012 | Armstrong et al. |
| 8,191,560 | B2 | 6/2012 | Mallory et al. |
| 8,443,765 | B2 | 5/2013 | Hollis |
| 8,696,827 | B2 | 4/2014 | Ashrafzadeh et al. |
| 8,778,094 | B2 | 7/2014 | Blanchard et al. |
| 8,858,729 | B2 | 10/2014 | Buddharaju et al. |
| 8,900,375 | B2 | 12/2014 | Gnadinger et al. |
| 8,915,257 | B2 | 12/2014 | Büsing et al. |
| 8,932,411 | B2 | 1/2015 | Beaudet et al. |
| 8,978,674 | B2 | 3/2015 | Buesing |
| 8,985,128 | B2 | 3/2015 | Pyo et al. |
| 9,121,217 | B1 | 9/2015 | Hoffberg |
| 9,170,584 | B2 | 10/2015 | Lum et al. |
| 9,204,780 | B2 | 12/2015 | Francisco et al. |
| 9,220,393 | B2 | 12/2015 | Becker et al. |
| 9,241,604 | B2 | 1/2016 | Dries |
| 9,259,137 | B2 | 2/2016 | Boyer et al. |
| 9,265,400 | B2 | 2/2016 | Bigott |
| 9,307,888 | B2 | 4/2016 | Baldwin et al. |
| 9,326,657 | B2 | 5/2016 | Thiyagarajan |
| 9,480,389 | B2 | 11/2016 | Haft et al. |
| 9,492,055 | B2 | 11/2016 | Feddema |
| 9,532,700 | B2 | 1/2017 | Welch |
| 9,635,994 | B2 | 5/2017 | Boyer et al. |
| 9,655,496 | B2 | 5/2017 | Baldwin et al. |
| 9,915,356 | B2 | 3/2018 | Chang et al. |
| 9,958,073 | B2 | 5/2018 | Yang |
| 10,524,634 | B2 | 1/2020 | Digman |
| 10,531,781 | B2 | 1/2020 | Digman et al. |
| 10,631,708 | B2 | 4/2020 | Digman et al. |
| 10,765,291 | B2 | 9/2020 | Digman et al. |
| 11,000,176 | B2 | 5/2021 | Digman |
| 2005/0011544 | A1 | 1/2005 | Rosenbauer et al. |
| 2005/0139240 | A1 | 6/2005 | Bong et al. |
| 2005/0241680 | A1 | 11/2005 | Noh |
| 2005/0241681 | A1 | 11/2005 | Hwang |
| 2006/0090778 | A1 | 5/2006 | Oakes et al. |
| 2006/0278258 | A1 | 12/2006 | Kara et al. |
| 2007/0215187 | A1 | 9/2007 | Koch et al. |
| 2008/0163904 | A1 | 7/2008 | Hwang |
| 2008/0271765 | A1 | 11/2008 | Burrows |
| 2008/0276975 | A1 | 11/2008 | Disch |
| 2009/0071508 | A1 | 3/2009 | Sundaram et al. |
| 2009/0090400 | A1 | 4/2009 | Burrows et al. |
| 2009/0145468 | A1 | 6/2009 | Chericoni |
| 2010/0043826 | A1 | 2/2010 | Bertsch et al. |
| 2011/0186085 | A1 | 8/2011 | Chen et al. |
| 2012/0060875 | A1 | 3/2012 | Fauth et al. |
| 2012/0097199 | A1 | 4/2012 | Tuller |
| 2012/0175431 | A1 | 7/2012 | Althammer et al. |
| 2012/0291827 | A1 | 11/2012 | Buddharaju et al. |
| 2013/0000762 | A1 | 1/2013 | Buddharaju et al. |
| 2013/0068265 | A1 | 3/2013 | Gnadinger et al. |
| 2013/0137621 | A1 | 5/2013 | Kessler et al. |
| 2013/0319483 | A1 | 12/2013 | Welch |
| 2014/0059880 | A1 | 3/2014 | Bertsch et al. |
| 2014/0069470 | A1 | 3/2014 | Baldwin et al. |
| 2014/0345654 | A1 | 11/2014 | Cho et al. |
| 2014/0373876 | A1 | 12/2014 | Feddema |
| 2015/0007861 | A1 | 1/2015 | Azmi et al. |
| 2015/0182102 | A1* | 7/2015 | Hong ..... A47L 15/18 134/182 |
| 2015/0266065 | A1 | 9/2015 | Savoia |
| 2016/0198928 | A1 | 7/2016 | Xu et al. |
| 2017/0135548 | A1 | 5/2017 | Swarnkar |
| 2017/0181599 | A1 | 6/2017 | Choi et al. |

(56) References Cited

U.S. PATENT DOCUMENTS

| | | | |
|---|---|---|---|
| 2017/0224190 | A1 | 8/2017 | Sakthivel et al. |
| 2017/0265707 | A1 | 9/2017 | Roderick et al. |
| 2017/0273535 | A1 | 9/2017 | Roderick et al. |
| 2017/0354308 | A1 | 12/2017 | Choi et al. |
| 2018/0035863 | A1 | 2/2018 | Liu et al. |
| 2018/0084967 | A1 | 3/2018 | Ross et al. |
| 2018/0110397 | A1 | 4/2018 | Kim et al. |
| 2018/0132692 | A1 | 5/2018 | Dries |
| 2018/0168425 | A1 | 6/2018 | Wilson et al. |
| 2018/0192851 | A1 | 7/2018 | Gursoy et al. |
| 2018/0220870 | A1 | 8/2018 | Beshears, Jr. et al. |
| 2018/0333037 | A1 | 11/2018 | Roderick et al. |
| 2018/0360293 | A1 | 12/2018 | Boyer |
| 2019/0059688 | A1 | 2/2019 | Woo et al. |
| 2019/0099054 | A1 | 4/2019 | Digman et al. |
| 2019/0099056 | A1 | 4/2019 | Digman |
| 2019/0191959 | A1 | 6/2019 | Brightbill et al. |
| 2019/0290095 | A1 | 9/2019 | Wahlberg et al. |
| 2019/0307308 | A1 | 10/2019 | Haegermarck |
| 2020/0077868 | A1 | 3/2020 | Digman et al. |
| 2020/0085277 | A1 | 3/2020 | Digman et al. |
| 2020/0085278 | A1 | 3/2020 | Digman et al. |
| 2020/0085279 | A1 | 3/2020 | Digman et al. |
| 2020/0107696 | A1 | 4/2020 | Digman et al. |
| 2020/0288940 | A1 | 9/2020 | Fawaz et al. |
| 2021/0251462 | A1 | 8/2021 | Boyer |
| 2021/0267430 | A1 | 9/2021 | Digman et al. |
| 2022/0087500 | A1 | 3/2022 | Boyer et al. |

FOREIGN PATENT DOCUMENTS

| | | | |
|---|---|---|---|
| CN | 1879547 | A | 12/2006 |
| CN | 101049224 | A | 10/2007 |
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106574786 | A | 4/2017 |
| CN | 105286746 | B | 2/2018 |
| CN | 108697298 | A | 10/2018 |
| CN | 109538865 | A | 3/2019 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |
| WO | 2020052211 | A1 | 3/2020 |
| WO | 2020052215 | A1 | 3/2020 |

OTHER PUBLICATIONS

Transmittal of Related Applications.

Electrolux Home Products, Inc. "Dishwasher Use & Care Guide 1500 Series with Fully Electronic Control" 2003.

International Search Report and Written Opinion issued in Application No. PCT/CN2018/074294 dated Jul. 5, 2018.

International Search Report and Written Opinion issued in Application No. PCT/CN2018/074268 dated Jul. 13, 2018.

International Search Report and Written Opinion issued in Application No. PCT/CN2019/079236 dated Jun. 25, 2019.

International Search Report and Written Opinion issued in Application No. PCT/CN2019/078799 dated Jun. 26, 2019.

International Search Report and Written Opinion issued in Application No. PCT/CN2019/078612 dated Jun. 28, 2019.

Scribd, Sears Kenmore Elite 2013 Stainless Steel Tall Tub Dishwasher Service Manual, www.scribd.com, Retrieved on Dec. 5, 2018.

U.S. Patent Office; Non-Final Office Action issued in U.S. Appl. No. 15/721,099 dated Jul. 30, 2019.

DE10121083A1 machine translation (Year: 2002).

Everyspec, Federal Specification: Dishwashing Machines, Single Tank and Double Tank, Commercial, www.everyspec.com, Oct. 17, 1983.

International Search Report and Written Opinion issued in Application No. PCT/CN2019/078611 dated Jun. 5, 2019.

U.S. Patent and Trademark Office, Office Action issued in related U.S. Appl. No. 15/721,091 dated May 23, 2019.

U.S. Patent and Trademark Office, Office Action issued in related U.S. Appl. No. 15/721,091 dated Oct. 11, 2019.

U.S. Patent Office; Notice of Allowance issued in U.S. Appl. No. 15/721,091 dated Oct. 23, 2019.

U.S. Patent and Trademark Office, Office Action issued in related U.S. Appl. No. 15/721,099 dated Nov. 4, 2019.

U.S. Patent Office; Notice of Allowance issued in U.S. Appl. No. 15/721,099 dated Nov. 18, 2019.

International Search Report and Written Opinion issued in Application No. PCT/CN2019/097332 dated Dec. 9, 2019.

U.S. Patent and Trademark Office, Notice of Allowance ssued in U.S. Appl. No. 16/132,091 dated Mar. 18, 2020.

U.S. Patent and Trademark Office, Office Action ssued in U.S. Appl. No. 16/132,114 dated Apr. 9, 2020.

U.S. Patent and Trademark Office, Office Action ssued in U.S. Appl. No. 16/132,106 datedJul. 23, 2020.

U.S. Patent and Trademark Office, Notice of Allowance ssued in U.S. Appl. No. 16/132,114 dated Jul. 27, 2020.

U.S. Patent and Trademark Office, Office Action issued in U.S. Appl. No. 16/298,007 dated Oct. 19, 2020.

Encyclo, "Keyed Connector—Definition—Encyclo", https://www.encyclo.co.uk/meaning-of-Keyed_connectors, 2020.

U.S. Patent and Trademark Office, Final Office Action issued in U.S. Appl. No. 16/132,106 dated Jan. 7, 2021.

(56) References Cited

OTHER PUBLICATIONS

International Search Report and Written Opinion issued in Application No. PCT/CN2020/108004 dated Oct. 26, 2020.
U.S. Patent and Trademark Office, Final Office Action issued in U.S. Appl. No. 16/298,007 dated Feb. 24, 2021.
U.S. Patent and Trademark Office, Advisory Action issued in U.S. Appl. No. 16/132,106 dated Mar. 26, 2021.
U.S. Patent and Trademark Office, Notice of Allowance issued in U.S. Appl. No. 16/132,106 dated Apr. 6, 2021.
U.S. Patent and Trademark Office, Office Action issued in U.S. Appl. No. 16/707,181 dated Apr. 7, 2021.
U.S. Patent and Trademark Office, Notice of Allowance issued in U.S. Appl. No. 16/707,181 dated May 6, 2021.
U.S. Patent and Trademark Office, Notice of Allowance issued in U.S. Appl. No. 16/298,007 dated May 19, 2021.
U.S. Patent and Trademark Office, Notice of Allowance issued in U.S. Appl. No. 16/132,125 dated Jun. 16, 2021.
European Patent Office, Communication issued in Application No. 19859390.7, 9 pages, dated Aug. 24, 2021.
International Search Report and Written Opinion issued in Application No. PCT/CN2021/110536 dated Oct. 26, 2021.
U.S. Patent and Trademark Office, Office Action issued in U.S. Appl. No. 16/795,484 dated May 18, 2022.
U.S. Patent and Trademark Office, Notice of Allowance issued in U.S. Appl. No. 16/795,484 dated Oct. 5, 2022.
Lorenzi, Marc, United States Patent and Trademark Office, Final Office Action issued in U.S. Appl. No. 17/225,442, 15 pages, dated Aug. 13, 2024.
U.S. Patent and Trademark Office, Notice of Allowance issued in U.S. App. No. 17/027,204 dated Jul. 11, 2022.
Ayalew, Tinsae B., United States Patent and Trademark Office, Notice of Allowance issued in U.S. Appl. No. 17/323,350, 23 pages, dated Jun. 28, 2023.

* cited by examiner

DISHWASHER WITH WALKING TUBULAR SPRAY ELEMENT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

SUMMARY

The herein-described embodiments address these and other problems associated with the art by providing a dishwasher and method for making and/or using the same utilizing one or more walking tubular spray elements that may be used to effectively increase the spray coverage area of the tubular spray elements through rotation and/or movement of the walking tubular spray elements in directions other than about the longitudinal axes thereof.

Therefore, consistent with one aspect of the invention, a dishwasher may include a wash tub, a fluid supply configured to supply fluid to the wash tub, a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, where the longitudinal axis is a first axis, and the tubular spray element is linearly movable along a second axis that is generally transverse to the first axis, and at least one tubular spray element drive coupled to the tubular spray element and configured to rotate the tubular spray element about the longitudinal axis and to move the tubular spray element linearly along the second axis.

In some embodiments, the at least one tubular spray element drive includes a first tubular spray element drive configured to rotate the tubular spray element about the longitudinal axis and a second tubular spray element drive configured to move the tubular spray element linearly along the second axis. In addition, some embodiments may further include a linear track, and the at least one tubular spray element drive is configured to rotate the tubular spray element about the longitudinal axis and to move the tubular spray element linearly along the second axis by rolling the tubular spray element along the track.

Consistent with another aspect of the invention, a dishwasher may include a wash tub including a back wall and first and second side walls, a fluid supply configured to supply fluid to the wash tub, a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and at least one tubular spray element drive coupled to the tubular spray element and configured to rotate the tubular spray element about longitudinal axis and to move the tubular spray element in a direction that is generally parallel to at least one of the back wall and the first and second side walls.

Also, in some embodiments, the at least one tubular spray element drive is configured to move the tubular spray element linearly in the direction that is generally parallel to the at least one of the back wall and the first and second side walls. Further, in some embodiments, the at least one tubular spray element drive is configured to move the tubular spray element within a substantially horizontal plane. In some embodiments, the at least one tubular spray element drive is configured to move the tubular spray element within a substantially vertical plane. In addition, in some embodiments, the at least one tubular spray element drive includes first and second tubular spray element drives, the first tubular spray element drive configured to rotate the tubular spray element about the longitudinal axis, and the second tubular spray element drive configured to move the tubular spray element in the direction that is generally parallel to the at least one of the back wall and the first and second side walls.

Consistent with another aspect of the invention, a dishwasher may include a wash tub, a fluid supply configured to supply fluid to the wash tub, a tubular spray element disposed in the wash tub and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, where the longitudinal axis is a first axis, and the tubular spray element is rotatable about a second axis that is generally transverse to the first axis and positioned proximate a corner of the wash tub, and at least one tubular spray element drive coupled to the tubular spray element and configured to rotate the tubular spray element about the longitudinal axis and to rotate the tubular spray element about the second axis.

In some embodiments, the second axis is disposed proximate an end of the tubular spray element such that an opposite end of the tubular spray element moves along an arcuate path when rotated about the second axis by the at least one tubular spray element drive. In addition, in some embodiments, the tubular spray element is a first tubular spray element, the corner is a first corner of the wash tub, the dishwasher further includes a second tubular spray element disposed in the wash tub and being rotatable about a third, longitudinal axis thereof, the second tubular spray element is further rotatable about a fourth axis that is generally transverse to the third axis, the fourth axis is disposed proximate an end of the second tubular spray element, is generally parallel to the second axis and is disposed proximate an opposite corner of the wash tub from the first corner, and the at least one tubular spray element drive is further configured to rotate the second tubular spray element about each of the third and fourth axes.

Moreover, in some embodiments, the first and second tubular spray elements are configured to rotate about the second and fourth axes generally within a same plane, and the dishwasher further includes a controller coupled to the at least one tubular spray element drive to coordinate rotation of the first and second tubular spray elements to substantially cover a cross-sectional area of the wash tub without collision between the first and second tubular spray elements. In some embodiments, the first and second tubular spray elements are configured to rotate about the second and fourth axes generally within separate planes to avoid collision between the first and second tubular spray elements.

Consistent with another aspect of the invention, a dishwasher may include a wash tub, a fluid supply configured to supply fluid to the wash tub, a track defining a path of travel, a tubular spray element disposed in the wash tub and engaged with the track, the tubular spray element being rotatable about a longitudinal axis thereof and including one or more apertures extending through an exterior surface thereof, and the tubular spray element in fluid communication with the fluid supply to direct fluid from the fluid supply into the wash tub through the one or more apertures, and at least one tubular spray element drive coupled to the tubular spray element and configured to rotate the tubular spray element about the longitudinal axis and to move the tubular spray element along the path of travel defined by the track.

Moreover, in some embodiments, the track includes a plurality of teeth extending along at least a portion of the path of travel and the tubular spray element includes a toothed gear coupled thereto and rotatable about the longitudinal axis, and the at least one tubular spray element drive is configured to move the tubular spray element along the path of travel defined by the track by rotating the toothed gear along the path of travel to engage with the plurality of teeth. In some embodiments, the toothed gear is fixedly mounted to the tubular spray element such that rotation of the toothed gear rotates the tubular spray element about the longitudinal axis and moves the tubular spray element along the path of travel defined by the track. In addition, in some embodiments, the track includes first and second opposing guides, and the plurality of teeth extend along the first opposing guide and the second opposing guide includes a non-toothed surface.

In some embodiments, the tubular spray element is configured to rotate while moving along at least a portion of the path of travel defined by the track. Moreover, in some embodiments, the tubular spray element is configured to maintain a predetermined rotational orientation while moving along at least a portion of the path of travel defined by the track. Also, in some embodiments, at least a portion of the path of travel extends linearly. In some embodiments, at least a portion of the path of travel is curved. In addition, in some embodiments, the path of travel forms a closed loop. Also, in some embodiments, the path of travel includes first and second linear portions extending substantially parallel to one another and joined at common ends by a curved portion of the path of travel.

Moreover, in some embodiments, the wash tub includes a back wall and first and second side walls, and the track is generally parallel to at least one of the back wall and the first and second side walls. Some embodiments may further include a rotatable supply tube coupled to and in fluid communication between the fluid supply and the tubular spray element to supply fluid from the fluid supply to the tubular spray element, the rotatable supply tube coupled to the tubular spray element through first and second ball joints, and the rotatable supply tube coupled to the at least one tubular spray element drive such that rotation of the rotatable supply tube by the at least one tubular spray element drive causes the tubular spray element to move along the path of travel defined by the track.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
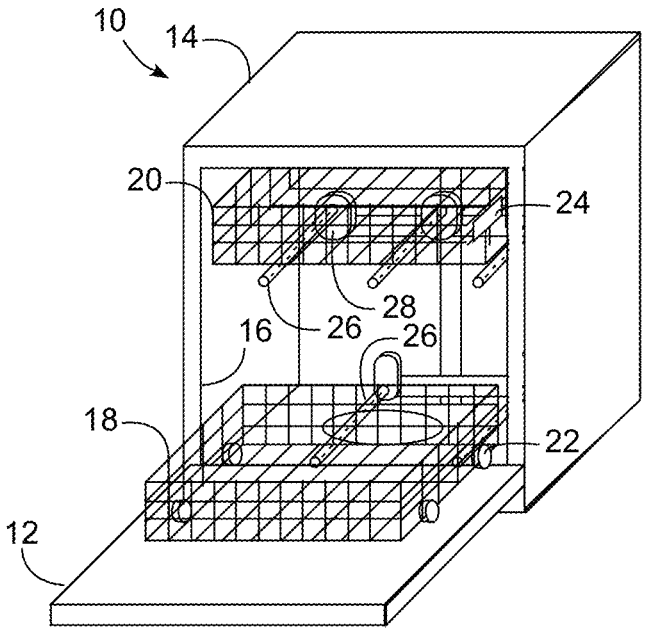
FIG. 1 is a perspective view of a dishwasher consistent with some embodiments of the invention.

In some embodiments consistent with the invention, one or more walking tubular spray elements may be used in a dishwasher to effectively increase the spray coverage area of the tubular spray elements through rotation and/or movement of the walking tubular spray elements in directions other than about the longitudinal axes thereof.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and may be discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
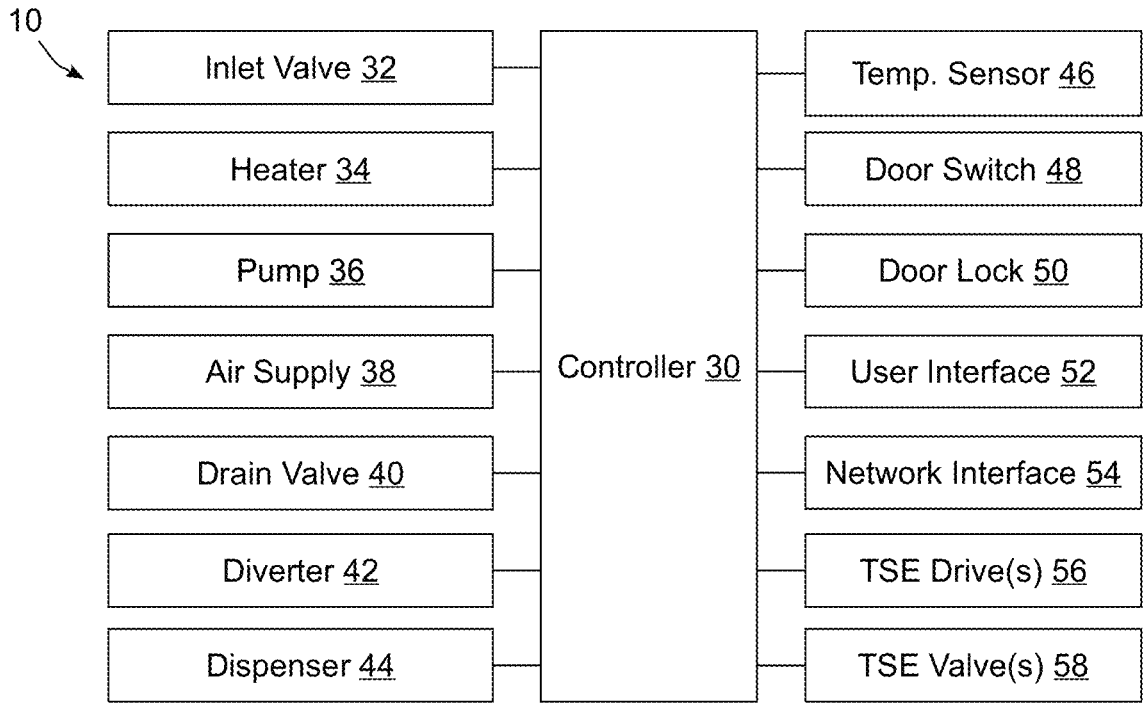
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein.

Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
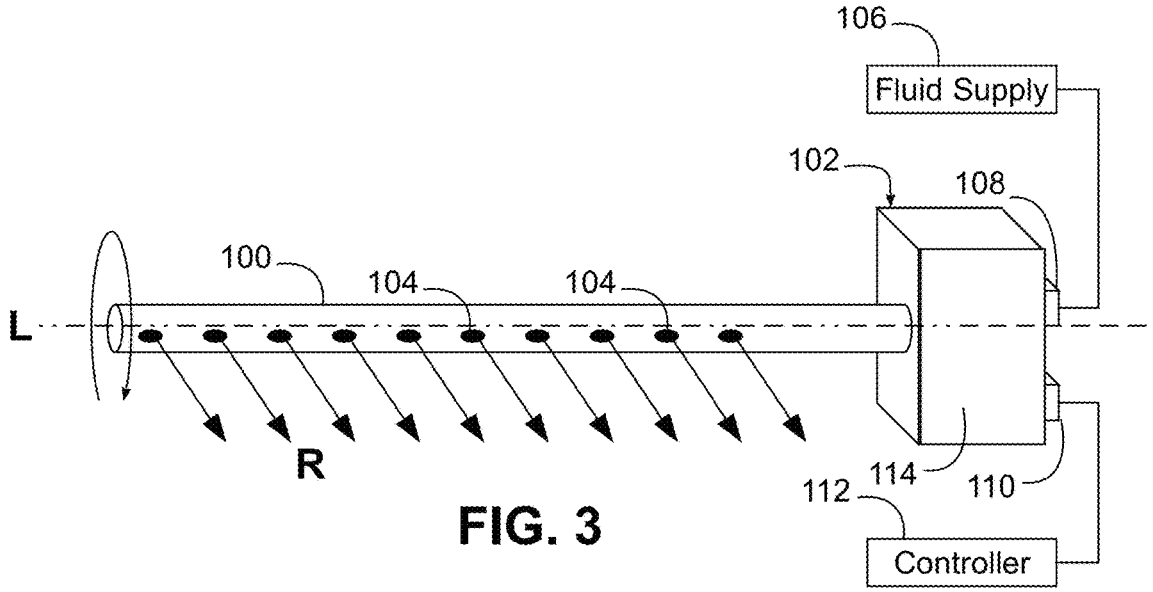
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
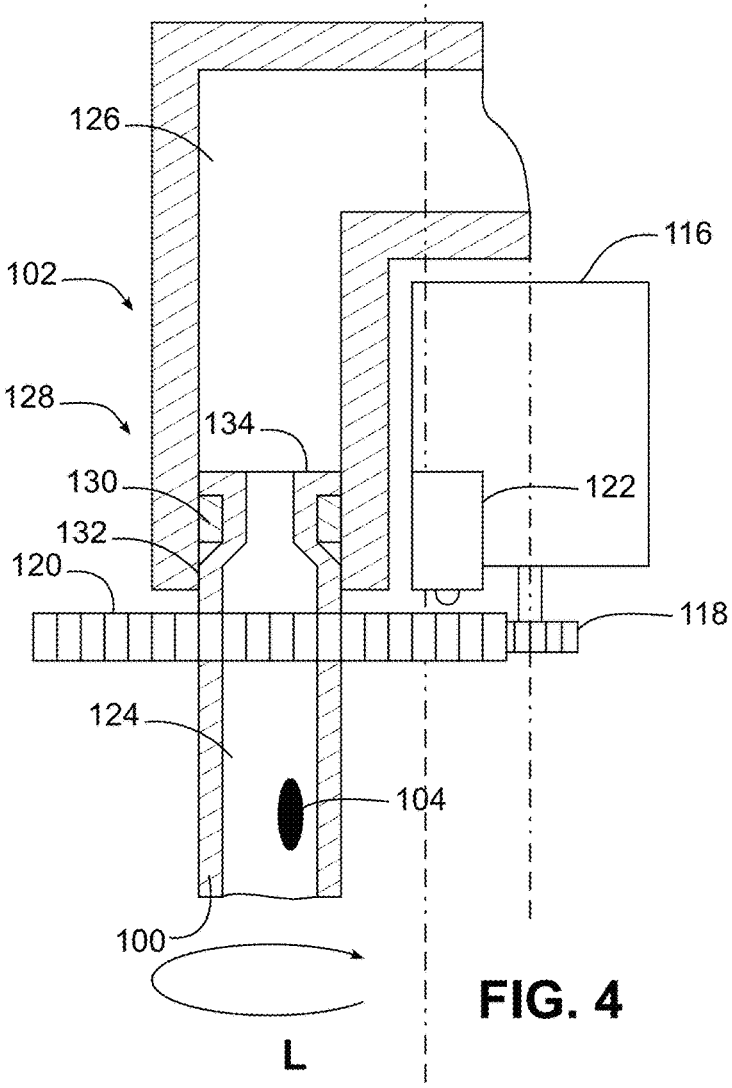
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
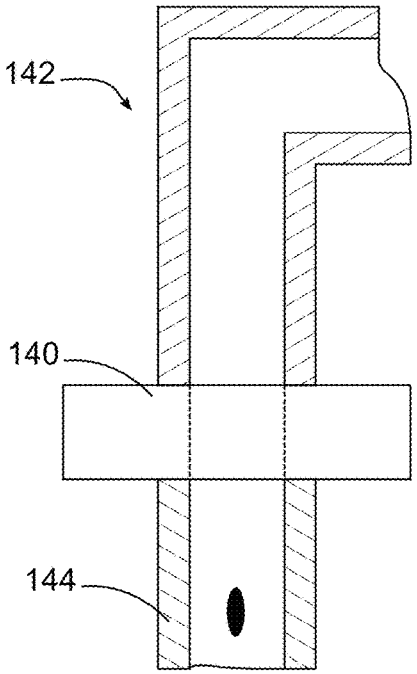
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
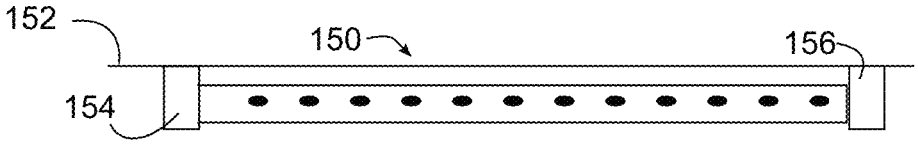
FIG. 6 is a functional top plan view of an example implementation of a wall-mounted tubular spray element and tubular spray element drive consistent with some embodiments of the invention.
Figure 7:
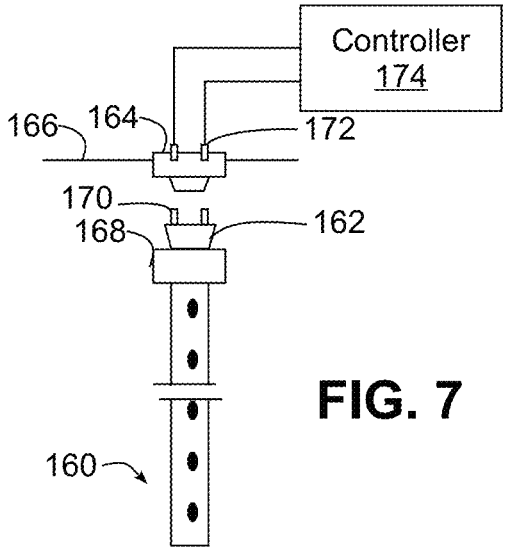
FIG. 7 is a functional top plan view of an example implementation of a rack-mounted tubular spray element and tubular spray element drive consistent with some embodiments of the invention.
Figure 8:
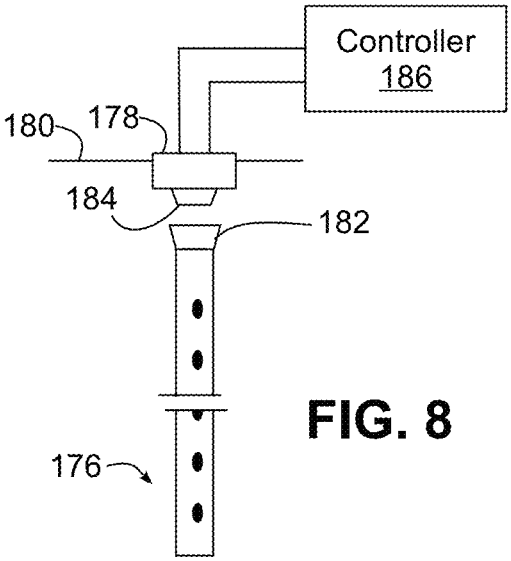
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
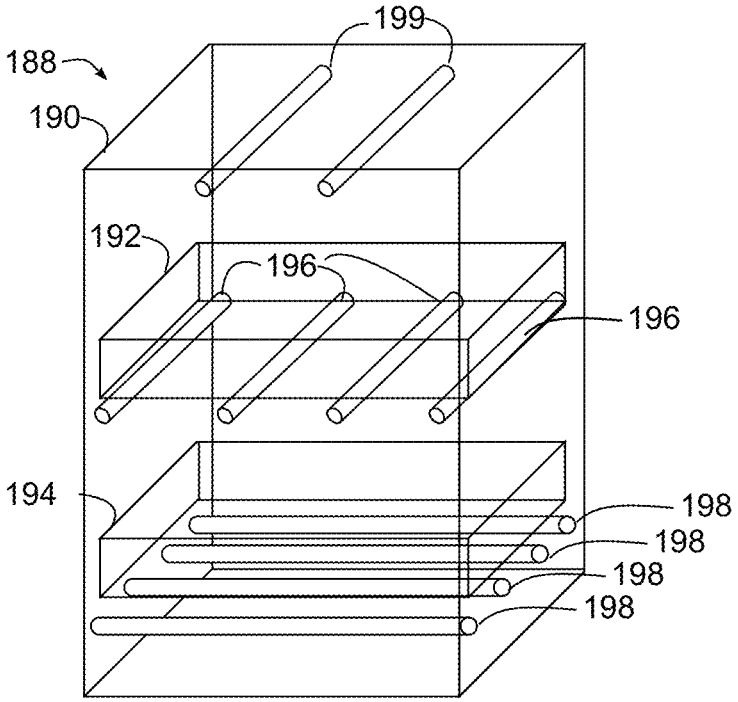
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Walking Tubular Spray Elements

As noted above, it may be desirable in some embodiments to provide a tubular spray element, also referred to herein as a walking tubular spray element, that is also rotatable or otherwise movable in addition to rotating about its longitudinal axis, as well as in different planes. One limitation of non-walking tubular spray elements, which rotate about a longitudinal axis that is substantially fixed in both position and orientation in a dishwasher, is that the spray coverage area can be fairly limited for some applications. Generally, the spray coverage area of a sprayer is the integral of the jet diameter over the sweep of rotation, and the only manner of increasing the spray coverage area is through larger sweeps. For some applications, however, it may be desirable to configure a tubular spray element to rotate or move in a direction other than about its longitudinal axis to increase the integrated area of the spray coverage.

Figure 10:
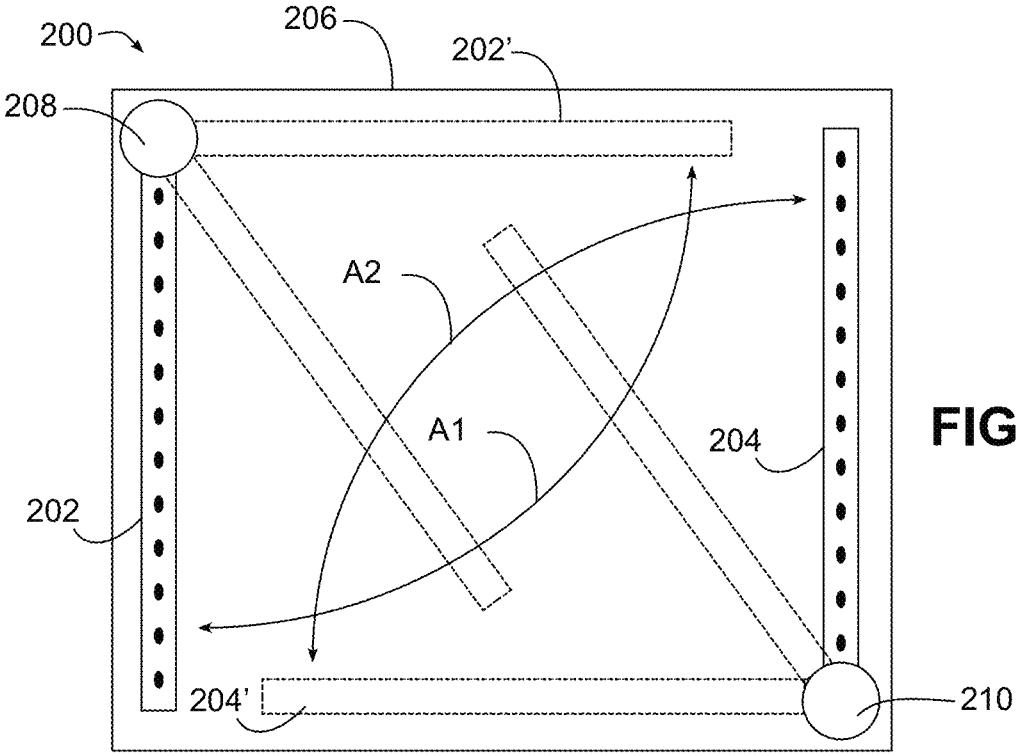
FIG. 10 is a functional top plan view of an example implementation of a tubular spray element that is additionally rotatable about a transverse axis consistent with some embodiments of the invention.

FIG. 10, for example, illustrates a dishwasher 200 including a wash tub 206 and first and second tubular spray elements 202, 204. Each tubular spray element 202, 204, in addition to rotating about its longitudinal axis, is also rotatable about a respective hub 208, 210 disposed in opposing corners of wash tub 206. Each hub 208, 210 defines an axis of rotation that is generally transverse to the longitudinal axis of the respective tubular spray element 202, 204, and the axis of rotation is disposed proximate one end of the respective tubular spray element 202, 204 such that an opposite end of the respective tubular spray element 202, 204 moves along an arcuate path A1, A2, e.g., to the positions 202', 204' shown in dotted lines.

It will be appreciated that each hub 208, 210 may include multiple tubular spray element drives, including one tubular spray element drive for rotating the tubular spray element 202, 204 about its longitudinal axis and one tubular spray element drive for rotating the tubular spray element 202, 204 about the transverse axis of rotation. In some embodiments, the two drives may also be interconnected and/or share common components (e.g., gears and/or motors). In other embodiments, tubular spray element drives for rotating about a longitudinal axis and/or rotating about a transverse axis of rotation may be separate from the hub 202, 204 and mechanically coupled in an appropriate manner that will be appreciated by those of ordinary skill having the benefit of the instant disclosure.

It will be appreciated that through the movement of tubular spray elements along paths A1, A2, substantially the entire cross-section of wash tub 206 may be covered, including the corners, thereby minimizing dead zones where insufficient spraying occurs. Furthermore, it will be appreciated that, in order to avoid collisions between tubular spray elements 202, 204, the tubular spray elements may be configured to rotate in different planes (e.g., at different elevations in the wash tub), or alternatively control of the position of each tubular spray element 202, 204 along paths A1, A2 may be coordinated to avoid collisions, even where the elements are in the same plane.

Figure 11:
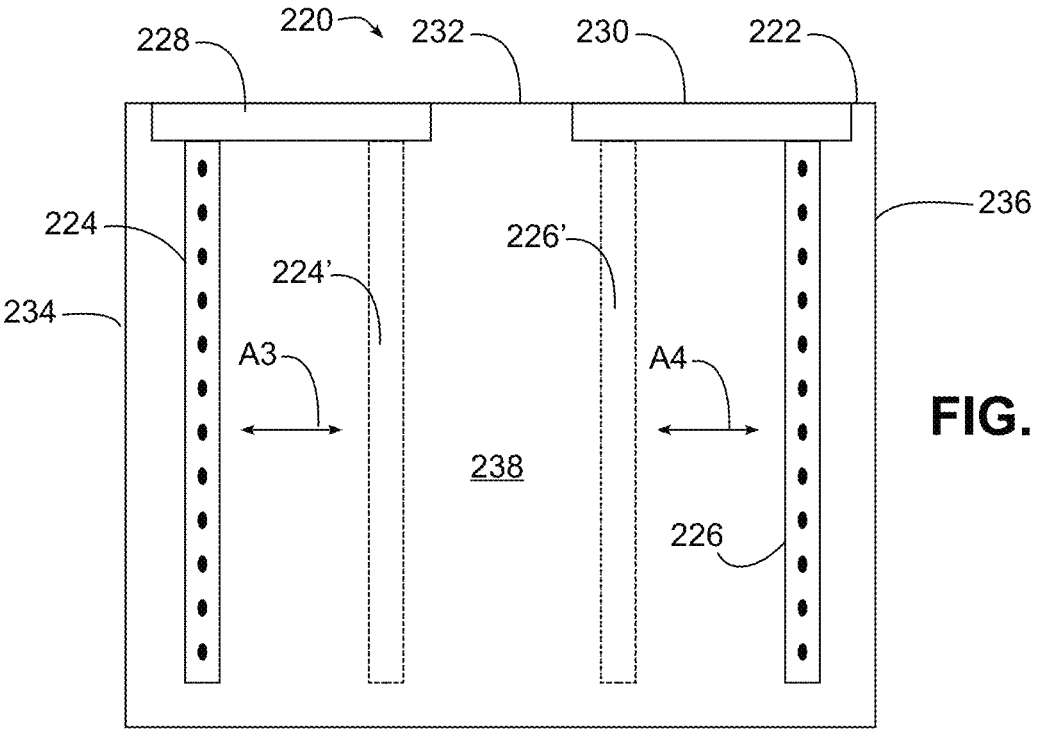
FIG. 11 is a functional top plan view of an example implementation of a tubular spray element that is additionally movable about a transverse axis consistent with some embodiments of the invention.

Now turning to FIG. 11, tubular spray elements may also be movable in addition to or in lieu of being rotatable as illustrated in FIG. 10. FIG. 11, in particular, illustrates a dishwasher 220 including a wash tub 222 and a pair of tubular spray elements 224, 226 that are supported on tracks 228, 230 to move generally linearly along an axis A3, A4, which is generally transverse to the longitudinal axis of the respective tubular spray element 224, 226 (e.g., to the positions 224', 226' shown in dotted lines). Each track 228, 230 may include multiple tubular spray element drives, including one tubular spray element drive for moving the tubular spray element 224, 226 about its longitudinal axis and one tubular spray element drive for moving the tubular spray element 224, 226 along the transverse axis A3, A4. In some embodiments, the two drives may also be interconnected and/or share common components (e.g., gears and/or motors). As one example, tracks 228, 230 may be configured to "roll" tubular spray elements 224, 226 like logs between the respective positions 224, 224' and 226, 226' using a single motor, and in some instances, valves may be configured to turn off fluid flow at certain rotational positions (e.g., to avoid hitting walls of the wash tub). In other embodiments, tubular spray element drives for rotating about a longitudinal axis and/or moving along a transverse axis may be separate from the track 228, 230 and mechanically coupled in an appropriate manner that will be appreciated by those of ordinary skill having the benefit of the instant disclosure.

It will be appreciated that movement of tubular spray elements 224, 226 along axes A3, A4 is generally parallel to back wall 232 of wash tub 222. In other embodiments, however, e.g., where a tubular spray element is supported by or otherwise extends from a side wall such as one of side walls 234, 236 of wash tub 222, such a tubular spray element may be movable in a direction that is generally parallel to one or both of those side walls. Furthermore, if a tubular spray element is movable in a generally vertical plane, rather than the horizontal plane 238 for the arrangement of FIG. 11, generally parallel movement relative to one or more of back wall 232 and side walls 234, 236 may also occur. In addition, if a tubular spray element is movable in a direction along its longitudinal axis, it may also be considered to incorporate generally parallel movement relative to one or more of back wall 232 and side walls 234, 236.

Furthermore, it will be appreciated that in some embodiments, movement of a tubular spray element beyond about its longitudinal axis may include a path of travel that is not necessarily linear, generally transverse to the longitudinal axis and/or generally parallel to a back and/or side wall of the wash tub along its entire length. The path of travel, for example, may include one or more linear and/or curved sections, and may be limited to a single dimension in some instances, but alternatively may include movement in two or more dimensions in other instances. In some instances, rotation about one or more axes other than the longitudinal axis may also be used within the path of travel for a tubular spray element.

Figure 12:
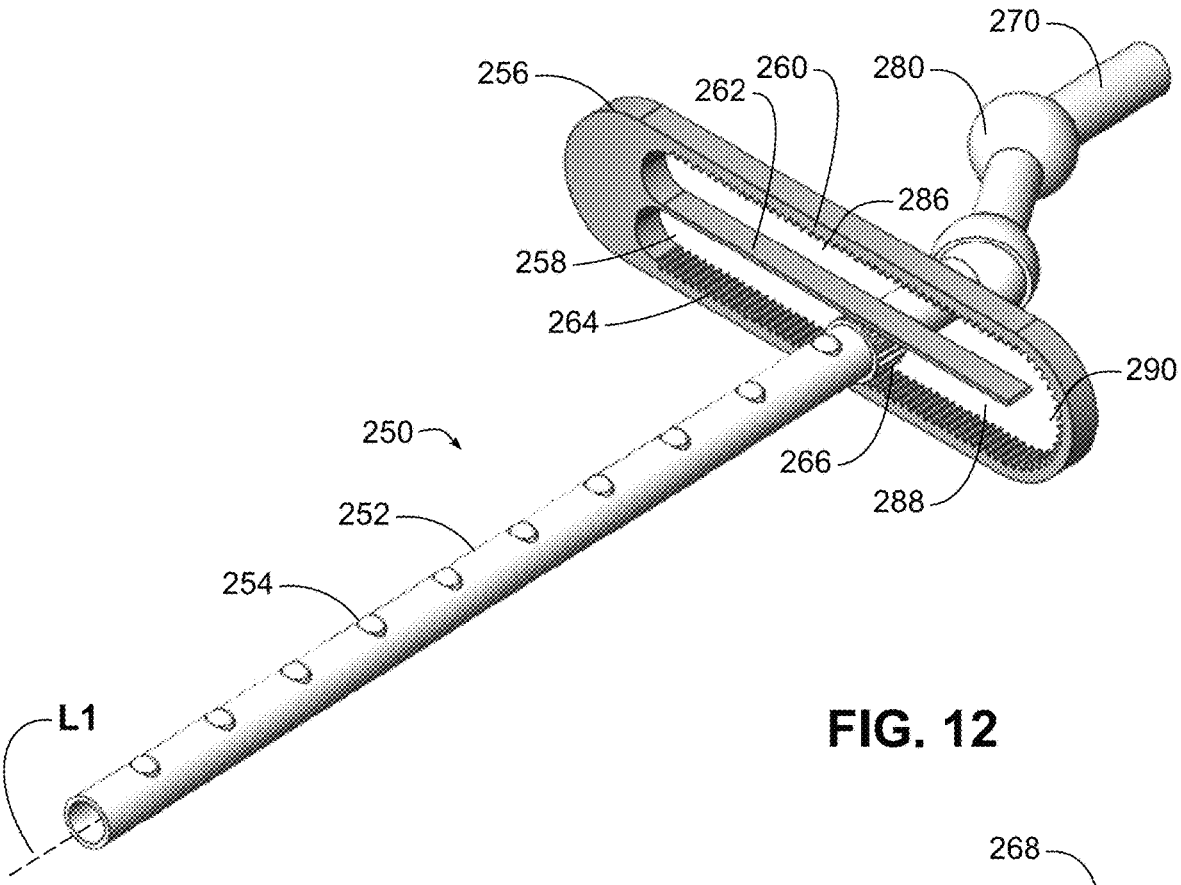
FIG. 12 is a perspective view of an example implementation of a walking tubular spray element consistent with some embodiments of the invention.
Figure 13:
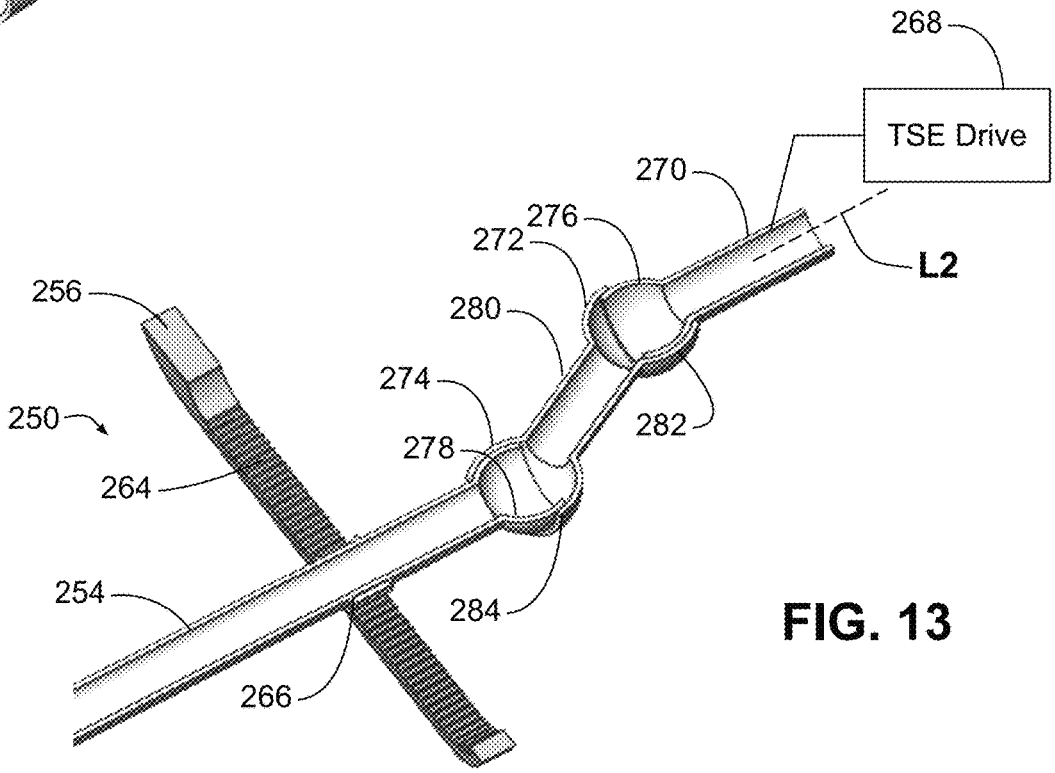
FIG. 13 is a perspective cross-sectional view of the walking tubular spray element of FIG. 12.

FIGS. 12 and 13, for example, illustrate a tubular spray element 250 including an exterior surface 252 with one or more apertures 254 and supported by a track 256 defining a path of travel 258. Tubular spray element 250 is rotatable about an axis of rotation L1 and is further movable along path of travel 258. In some embodiments, track 256 may be mounted to a back or side wall of a dishwasher tub such that the track is generally parallel to the back or side wall.

In this embodiment, path of travel 258 is defined by a pair of opposing guides 260, 262, with guide 260 having a toothed surface including a plurality of teeth 264 suitable for engaging with a toothed gear 266 formed or otherwise mounted on elongated tube 252 of tubular spray element 250, such that rotation of toothed gear 266 causes tubular spray element 250 to travel along path of travel 258 as a result of the engagement of toothed gear 266 with teeth 264. Guide 262 includes a non-toothed, e.g., a substantially smooth, surface so as to not engage with toothed gear 266 as the tubular spray element moves along the path of travel.

In the embodiment of FIGS. 12-13, toothed gear 266 is fixedly mounted to (e.g., integrally formed on) tubular spray element 250 such that rotation of toothed gear 266 rotates tubular spray element 250 about longitudinal axis L1 and moves the tubular spray element along path of travel 258 defined by track 256. By doing so, tubular spray element 250 effectively "rolls" along the track, both rotating about its longitudinal axis and following the path of travel defined by the track.

A tubular spray element drive, functionally illustrated at 268 in FIG. 13, and capable of being implemented in any of the various manners discussed herein, may be used to provide both the rotation of the tubular spray element 250 about longitudinal axis L1 and movement along path of travel 258. While various other mechanical arrangements may be used in other embodiments, in this embodiment a rotatable supply tube 270 is mechanically coupled to tubular spray element drive 268 for rotation about its longitudinal axis L2. In addition, supply tube 270 is hollow and in fluid communication between a fluid supply (not shown in FIGS. 12-13) and tubular spray element 250 to supply fluid from the fluid supply to the tubular spray element.

A pair of ball joints 272, 274 couple rotatable supply tube 270 to tubular spray element 250, with inner ball joint ends 276, 278 defined at the ends of rotatable supply tube 270 and tubular spray element 250, respectively, and with an intermediate supply tube 280 defining outer ball joint ends 282, 284 that engage with inner ball joint ends 276, 278, respectively. With such an arrangement, longitudinal axis L2 of rotatable supply tube 270 may be fixed in position, while a fluid and mechanical coupling may be maintained between rotatable supply tube 270 and tubular spray element 250 as the longitudinal axis L1 of tubular spray element 250 travels along path of travel 258.

It will be appreciated that other mechanical couplings suitable for driving a tubular spray element along a path of travel may be used in other embodiments. Moreover, while the embodiment of FIGS. 12-13 utilizes a single tubular spray element drive 268 to both rotate tubular spray element 250 and move the tubular spray element to move along path of travel 258, in other embodiments the rotation of a tubular spray element may be decoupled from the movement of such a tubular spray element along a path of travel, such that, for example, the orientation of the spray pattern of the tubular spray element may be separately controllable from the position of the tubular spray element along the path of travel. In some instances, for example, a tubular spray element may be configured to maintain a predetermined rotational orientation as it moves along at least a portion of a path of travel, or to sweep between a range of rotational orientations during such movement. In addition, where, for example, it is desirable to shut off a tubular spray element during a portion of its movement, the rotational orientation may be controlled to rotate to a predetermined rotational orientation that shuts off the supply of fluid to the tubular spray element during at least a portion of the movement along the path of travel.

Figure 14:
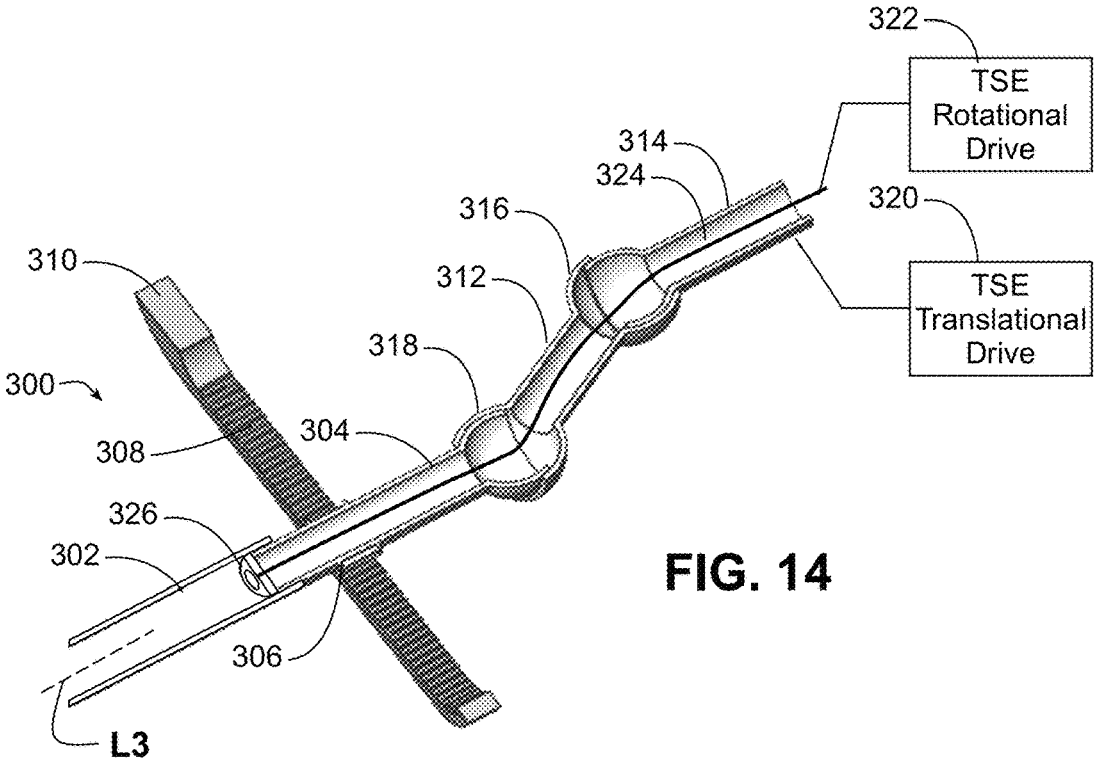
FIG. 14 is a perspective cross-sectional view of another example implementation of a walking tubular spray element consistent with some embodiments of the invention, and including separate rotational and translational drives.

FIG. 14, for example, illustrates a tubular spray element 300 that is similar in construction to tubular spray element 250, but that includes an elongated tube 302 that is rotatably coupled to a guide tube 304 upon which a toothed gear 306 is formed for engaging with the teeth 308 of a track 310. Also, similar to tubular spray element 250, an intermediate supply tube 312 is coupled intermediate tubular spray element 300 and a rotatable supply tube 314, with a pair of ball joints 316, 318 coupling tubular spray element 300, intermediate supply tube 312 and rotatable supply tube 314 to one another, as well as allowing for fluid communication from rotatable supply tube 314 to tubular spray element 300.

A pair of tubular spray element drives 320, 322 are used to separately move tubular spray element 300 along track 310, and rotate tubular spray element 300 about its longitudinal axis L3. Tubular spray element drive 320, also referred to as a translational drive, causes rotation of rotatable supply tube 314, intermediate supply tube 312, guide tube 304, and thus toothed gear 306 to cause movement along the path of travel defined by track 310, in a similar manner to tubular spray element 250.

Tubular spray element drive 322, also referred to as a rotational drive, is coupled to elongated tube 302 of tubular spray element 320 to cause rotation of elongated tube 302 relative to guide tube 304 about longitudinal axis L3. In some embodiments, for example, a flexible cable 324 may extend through the interior of tubes 314, 312, and 304 and affix to a mounting block 326 formed in or otherwise mounted to elongated tube 302, such that rotation of flexible cable 324 causes relative rotation between elongated tube 302 and guide tube 304. As such, through coordination of tubular spray element drives 320, 322, both the rotational orientation of tubular spray element 300, and its movement along track 310, may be separately controlled.

It will be appreciated, however, that a wide variety of alternate arrangements may be used to separately control the rotational orientation and movement of a tubular spray element. Therefore, the invention is not limited to the particular arrangement disclosed herein.

Figure 15:
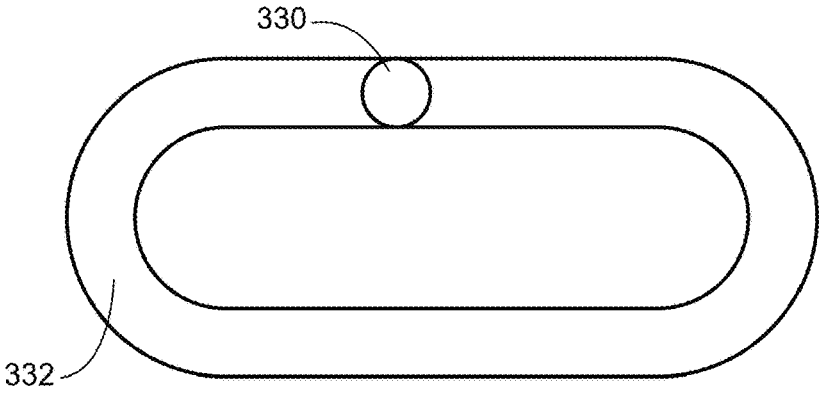
FIG. 15 is a functional elevational view of another example implementation of a walking tubular spray element consistent with some embodiments of the invention, and including a primarily horizontal closed loop.
Figure 16:
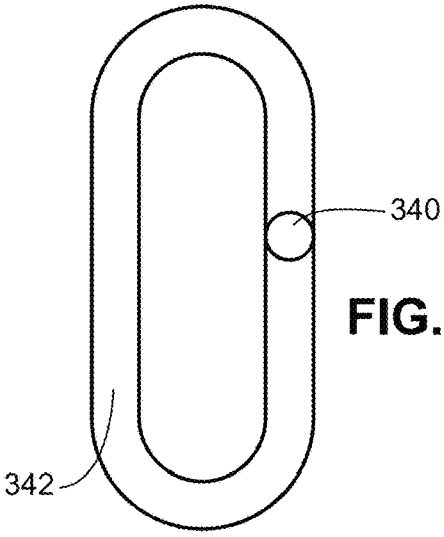
FIG. 16 is a functional elevational view of another example implementation of a walking tubular spray element consistent with some embodiments of the invention, and including a primarily vertical closed loop.
Figure 17:
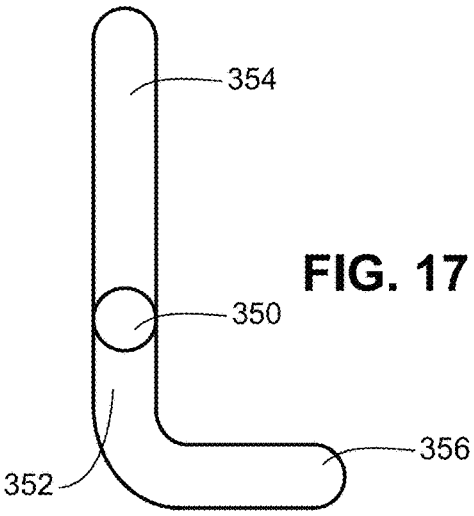
FIG. 17 is a functional elevational view of another example implementation of a walking tubular spray element consistent with some embodiments of the invention, and including a generally L-shaped track including horizontal and vertical portions.

Returning to FIGS. 12-13, it will be appreciated that the path of travel 258 defined by track 256 is generally U-shaped, and includes a pair of linear portions 286, 288 extending substantially parallel to one another and joined at common ends by a curved portion 290. However, an innumerable number of other path configurations may be used in other embodiments. FIG. 15, for example, illustrates a tubular spray element 330 engaged with a track 332 defining a closed loop path of travel that is primarily horizontal, while FIG. 16 illustrates a tubular spray element 340 engaged with a track 342 that also defines a closed loop path of travel that is primarily vertical. Both tracks 332, 342 include both linear and curved portions. FIG. 17 illustrates a tubular spray element 350 engaged with a track 352 that is primarily linear in nature, and includes vertical and horizontal portions 354, 356. Other paths of travel may be used in other embodiments, including various combinations of curved and linear portions, vertical portions, horizontal portions, angled portions, etc. Moreover, various paths of travel that are closed loop or continuous, or that include defined ends, may be used. It will be appreciated, for example, that based upon various structures within a dishwasher, e.g., racks, walls, particular types of utensil storage areas, as well as desired spray patterns, spray durations, spray intensities, etc., various different paths of travel may be better suited for different applications.

It will also be appreciated that where a track is not formed as a continuous loop, various types of position sensing may be used in some instances to detect when a tubular spray element reaches an end of a track, e.g., limit switches that are positioned proximate the ends of a track, or in other manners that would be appreciated by those of ordinary skill having the benefit of the instant disclosure. In addition, while tubular spray elements may be discretely directed in some embodiments, in other embodiments, it may be desirable to enable tubular spray elements to rotate uncontrollably or otherwise without concern for their precise rotational orientation.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A dishwasher, comprising:

a wash tub;

a fluid supply configured to supply fluid to the wash tub;

a tubular spray element disposed in the wash tub and being rotatable about a longitudinal axis thereof, the tubular spray element including opposing first and second ends separated from one another along the longitudinal axis thereof and one or more apertures extending through an exterior surface thereof, and the tubular spray element in fluid communication with the fluid supply through the first end of the tubular spray element to direct fluid from the fluid supply into the wash tub through the one or more apertures, wherein the longitudinal axis is a first axis, and wherein the tubular spray element is linearly movable along a second axis that is transverse to the first axis; and at least one tubular spray element drive coupled to the tubular spray element and configured to rotate the tubular spray element about the longitudinal axis and to move the tubular spray element linearly along the second axis.

2. The dishwasher of claim 1, wherein the at least one tubular spray element drive includes a first tubular spray element drive configured to rotate the tubular spray element about the longitudinal axis and a second tubular spray element drive configured to move the tubular spray element linearly along the second axis.

3. The dishwasher of claim 1, further comprising a linear track, wherein the at least one tubular spray element drive is configured to rotate the tubular spray element about the longitudinal axis and to move the tubular spray element linearly along the second axis by rolling the tubular spray element along the track.

4. A dishwasher, comprising:

a wash tub including a back wall and first and second side walls;

a fluid supply configured to supply fluid to the wash tub;

a tubular spray element disposed in the wash tub and being supported by one of the back wall and the first and second side walls for 360 degree rotation about a longitudinal axis thereof that extends perpendicular to the one of the back wall and the first and second side walls, the tubular spray element including one or more apertures extending through an exterior surface thereof, and the tubular spray element in fluid communication with the fluid supply to direct fluid from the fluid supply into the wash tub through the one or more apertures; and at least one tubular spray element drive coupled to the tubular spray element and configured to rotate the tubular spray element about the longitudinal axis and to move the tubular spray element in a direction that is parallel to the one of the back wall and the first and second side walls.

5. The dishwasher of claim 4, wherein the at least one tubular spray element drive is configured to move the tubular spray element linearly in the direction that is parallel to the one of the back wall and the first and second side walls.

6. The dishwasher of claim 5, wherein the at least one tubular spray element drive is configured to move the tubular spray element within a horizontal plane.

7. The dishwasher of claim 5, wherein the at least one tubular spray element drive is configured to move the tubular spray element within a vertical plane.

8. The dishwasher of claim 4, wherein the at least one tubular spray element drive includes first and second tubular spray element drives, the first tubular spray element drive configured to rotate the tubular spray element about the longitudinal axis, and the second tubular spray element drive configured to move the tubular spray element in the direction that is parallel to the one of the back wall and the first and second side walls.

9. A dishwasher, comprising:

a wash tub;

a fluid supply configured to supply fluid to the wash tub;

a track defining a path of travel;

a tubular spray element disposed in the wash tub and engaged with the track, the tubular spray element being rotatable about a longitudinal axis thereof and including one or more apertures extending through an exterior surface thereof, and the tubular spray element in fluid communication with the fluid supply to direct fluid from the fluid supply into the wash tub through the one or more apertures; and at least one tubular spray element drive coupled to the tubular spray element and configured to rotate the tubular spray element about the longitudinal axis and to move the tubular spray element along the path of travel defined by the track;

wherein the track includes a plurality of teeth extending along at least a portion of the path of travel and the tubular spray element includes a toothed gear coupled thereto and rotatable about the longitudinal axis, wherein the at least one tubular spray element drive is configured to move the tubular spray element along the path of travel defined by the track by rotating the toothed gear along the path of travel to engage with the plurality of teeth.

10. The dishwasher of claim 9, wherein the toothed gear is fixedly mounted to the tubular spray element such that rotation of the toothed gear rotates the tubular spray element about the longitudinal axis and moves the tubular spray element along the path of travel defined by the track.

11. The dishwasher of claim 9, wherein the track includes first and second opposing guides, wherein the plurality of teeth extend along the first opposing guide and the second opposing guide includes a non-toothed surface.

12. The dishwasher of claim 9, wherein the tubular spray element is configured to rotate while moving along at least a portion of the path of travel defined by the track.

13. The dishwasher of claim 9, wherein the tubular spray element is configured to maintain a predetermined rotational orientation while moving along at least a portion of the path of travel defined by the track.

14. The dishwasher of claim 9, wherein at least a portion of the path of travel extends linearly.

15. The dishwasher of claim 9, wherein at least a portion of the path of travel is curved.

16. The dishwasher of claim 9, wherein the path of travel forms a closed loop.

17. The dishwasher of claim 9, wherein the path of travel includes first and second linear portions extending parallel to one another and joined at common ends by a curved portion of the path of travel.

18. The dishwasher of claim 9, wherein the wash tub includes a back wall and first and second side walls, and wherein the track is parallel to at least one of the back wall and the first and second side walls.

19. The dishwasher of claim 9, further comprising a rotatable supply tube coupled to and in fluid communication between the fluid supply and the tubular spray element to supply fluid from the fluid supply to the tubular spray element, the rotatable supply tube coupled to the tubular spray element through first and second ball joints, and the rotatable supply tube coupled to the at least one tubular spray element drive such that rotation of the rotatable supply tube by the at least one tubular spray element drive causes the tubular spray element to move along the path of travel defined by the track.

* * * * *